US007634929B2

(12) United States Patent
Kuhnke et al.

(10) Patent No.: US 7,634,929 B2
(45) Date of Patent: Dec. 22, 2009

(54) CYLINDER CORE

(75) Inventors: Frank Kuhnke, Essen (DE); Armin Geurden, Grefrath (DE); Dirk Jacob, Heiligenhaus (DE)

(73) Assignee: HUF Hulsbeck & Furst GmbH & Co. KG (DE)

( * ) Notice: Subject to any disclaimer, the term of this patent is extended or adjusted under 35 U.S.C. 154(b) by 0 days.

(21) Appl. No.: 12/158,144

(22) PCT Filed: Feb. 27, 2006

(86) PCT No.: PCT/EP2006/001784

§ 371 (c)(1),
(2), (4) Date: Jun. 19, 2008

(87) PCT Pub. No.: WO2007/071293

PCT Pub. Date: Jun. 28, 2007

(65) Prior Publication Data

US 2008/0264123 A1 Oct. 30, 2008

(30) Foreign Application Priority Data

Dec. 20, 2005 (DE) ..... 10 2005 061 231

(51) Int. Cl.
*E05B 9/04* (2006.01)

(52) U.S. Cl. ..... 70/375; 70/373; 70/78; 292/DIG. 38

(58) Field of Classification Search ..... 70/373, 70/375, 377, 379 R, 492, 78, 79, 81; 292/DIG. 38
See application file for complete search history.

(56) References Cited

U.S. PATENT DOCUMENTS 3,499,209 A 3/1970 Laviana
3,702,553 A * 11/1972 Nolin ..... 70/375

(Continued)

FOREIGN PATENT DOCUMENTS

DE 55 51 686 10/1972

(Continued)

OTHER PUBLICATIONS

International Search Report PCT/EP2006/001784 Dated Aug. 31, 2006.

*Primary Examiner*—Suzanne D Barrett
(74) *Attorney, Agent, or Firm*—Cantor Colburn LLP

(57) ABSTRACT

The invention relates to a cylinder core (1) which can be mounted in a rotatable manner in a locking device, in particular of a storage compartment or of a glove compartment of a motor vehicle, and has a head region (6), which has a key channel (2) into which a key can be introduced, and a retaining region (7), which adjoins the head region (6) and is formed with a control means (8) which, when the cylinder core (1) is rotated about its axis of rotation (11), moves an arresting means, which is arranged in the locking device, for a closing and/or opening operation. The invention provides for the cylinder core (1) to have at least two material bodies (6, 7, 8), wherein a first material body (6, 7) is configured with the head region (6), which contains a first plastic, and a second material body (7, 8) is designed with the control means (8), which contains a second plastic, the second plastic having a higher strength than the first plastic.

17 Claims, 3 Drawing Sheets

U.S. PATENT DOCUMENTS

| | | | | | |
|---|---|---|---|---|---|
| 3,748,881 | A | * | 7/1973 | Erickson | 70/388 |
| 3,877,268 | A | * | 4/1975 | Shull | 70/492 |
| 4,052,870 | A | * | 10/1977 | Degeye et al. | 70/492 |
| 4,106,317 | A | * | 8/1978 | Anderson | 70/388 |
| 4,356,580 | A | * | 11/1982 | Kurtz | 70/14 |
| 4,550,580 | A | * | 11/1985 | Neyret | 70/370 |
| 4,620,430 | A | * | 11/1986 | Latone | 70/431 |
| 4,644,768 | A | * | 2/1987 | Nowak et al. | 70/492 |
| 4,669,287 | A | * | 6/1987 | Reader et al. | 70/360 |
| 4,890,467 | A | * | 1/1990 | Krause et al. | 70/369 |
| 4,910,982 | A | * | 3/1990 | Dana | 70/370 |
| 5,479,800 | A | * | 1/1996 | Myers | 70/365 |
| 5,479,801 | A | * | 1/1996 | Keller | 70/373 |
| 5,609,052 | A | | 3/1997 | Denning | |
| 5,626,041 | A | * | 5/1997 | Zaccaria | 70/370 |
| 5,630,632 | A | * | 5/1997 | Swan | 292/240 |
| 5,897,147 | A | * | 4/1999 | Alyanakian et al. | 292/175 |
| 5,970,762 | A | * | 10/1999 | Myers et al. | 70/492 |
| 6,161,404 | A | * | 12/2000 | Westwinkel | 70/370 |
| 6,263,713 | B1 | * | 7/2001 | Fantl | 70/492 |
| 6,810,703 | B1 | * | 11/2004 | Huang et al. | 70/373 |
| 7,059,160 | B2 | * | 6/2006 | Keller | 70/375 |
| 7,146,833 | B2 | * | 12/2006 | Ramsauer | 70/379 R |
| 7,194,876 | B1 | * | 3/2007 | Pacheco et al. | 70/1.5 |
| 7,350,382 | B2 | * | 4/2008 | Hoffmann | 70/139 |
| 7,360,382 | B2 | * | 4/2008 | Fernandez | 70/360 |
| 2001/0047673 | A1 | | 12/2001 | Schwab | |
| 2004/0020251 | A1 | | 2/2004 | Ramsauer | |

FOREIGN PATENT DOCUMENTS

| | | |
|---|---|---|
| DE | 23 01 816 | 1/1973 |
| DE | 25 13 037 | 3/1975 |
| DE | 9404108 | 6/1994 |
| DE | 199 39 261 | 8/1999 |
| DE | 201 15 083 | 12/2001 |
| FR | 1261278 | 5/1961 |
| FR | 2868803 | 10/2005 |

* cited by examiner

CYLINDER CORE

TECHNICAL FIELD OF THE INVENTION

The invention relates to a cylinder core that can be arranged to rotate in a closure device, especially a console storage compartment or glove compartment of a motor vehicle with a head area, having a key channel into which a key can be inserted and with a holding area connected to the head area, which is designed with a control device that moves a locking device arranged in the closure device for a closing and/or opening process, when the cylinder core is rotated about its axis of rotation.

BRIEF DISCUSSION OF RELATED ART

A number of embodiments of cylinder cores are known from the state of the art. These cylinders cores have different material properties in order to satisfy, in particular, the necessary material requirements in each area of application. For example, the cylinder core can be made from a material with higher strength, so that any high forces, torques, etc., acting on the cylinder core do not lead to its destruction.

Often, it is also necessary to adapt the cylinder core to its surroundings, especially in terms of color, which can be cost-intensive with high-strength materials. In addition, it has proven disadvantageous that undesired noises can develop within the mounting of the closure device in which the cylinder core is arranged during the closing and opening process, especially when high-strength plastics are used.

BRIEF SUMMARY OF THE INVENTION

The invention provides a cylinder core for a closure device in which the drawbacks mentioned are avoided. In particular, a cylinder core is provided that is simply configured, can be produced without significant cost, and can reliably perform its function within the closure cylinder.

For this purpose, it is prescribed according to the invention that the cylinder core have at least two material elements, a first material element being formed with the head area, which contains a first plastic, and a second material element being formed with the control device, which contains a second plastic, the second plastic having a higher strength than the first plastic. The head area is the area visible on the closure devices into which the key is inserted into the key channel. The diameter of the head area is generally greater than the diameter of the holding area, which is located beneath the head area. The holding area, which is introduced into a mounting of the closure device, is preferably essentially cylindrical. The holding area within the mounting also serves as a guide element that guarantees reliable rotation of the cylinder core. Since high forces, torques, etc., act especially on the control device, the control device is made of the second plastic. The head area, on the other hand, need not have such strength properties. The holding area, depending on the requirements, can be produced either from the first or the second plastic. This means that the first material element can be formed with the head area and the holding area in such a way that they are joined to each other in a material unit or that the second material element can be designed with the holding area and the control device, which are joined to each other in one material unit. By designing the cylinder core according to the invention with the material elements mentioned the required material properties can be effectively adjusted, in which case material costs with respect to the less essential second plastic can be reduced simultaneously.

The cylinder core advantageously comprises of an injection-molded part made of plastic, in which the first material element in one possible embodiment is molded onto the second material element so that a one-piece connection of the head area, the holding area, and the control device is achieved.

In one possible alternative, the first material element can have a coating that comprises of a metal. It is also conceivable to provide the first material element with a layer that has a color adapted in particular to the surroundings. As an alternative color additives can be embedded in the first plastic of a first material element, which can also be referred to as color pigments.

In a preferred embodiment of the invention, the cylinder core is produced by a 2C injection-molding process. In this two-component process, after solidification of the first plastic that forms the first material element, the cavity in the die is enlarged. The second plastic is then molded onto it with a second injection-molding unit. Two material elements, which have different material properties in their strength, electrical conductivity, etc. are thus advantageously force-fit and/or bonded to each other, without the possibility of rotation. Exclusive shape-mating between the first and second material elements is also possible. The first and second material elements thus form a one-piece assembly unit, whereby a compact cylinder core is achieved that can be arranged without significant expense in the closure device and the cylinder core has the required material properties simultaneously on the head area, holding area, and control device.

It is particularly advantageous that the head area is provided with a metal layer. The first plastic appropriately has corresponding material properties that permit the simplest possible metal coating. It can be advantageous here that the holding area and the control device comprises of the second plastic having higher strength. This is justified by the fact that greater force loads, for example, tensile, compressive, and/or shear forces generally act on the holding area and especially on the control device than on the head area.

In one possible alternative of the invention, the first material element, especially the first plastic, can be galvanized. Here, it is obvious to make the first plastic electrically conducting, in order to achieve satisfactory galvanic application of the desired metallic layer in sufficient thickness. During the galvanic process, electrolytic coating of the electrically conducting first material element occurs, whereby the second material element comprises of a nongalvanizable, especially nonelectrically-conducting plastic, so that metal coating does not occur there.

In a preferred embodiment of the invention, the plastic is an ABS material (acrylonitrile-butadiene-styrene copolymer), which preferably includes the three monomers acrylonitrile, butadiene, and styrene. The quantity ratios can then vary from 15 to 35% acrylonitrile, 5 to 30% butadiene, and 40 to 60% styrene. In addition to its physical property as a hard, scratch-resistant, tough, and chemically resistant plastic, ABS can also be galvanized.

The second material element in one possible embodiment of the invention can be the plastic PC (polycarbonate), which is not electrically conducting and has high strength, especially high impact strength. Naturally, alternative plastics can also be used for the second material element. Glass fibers, carbon fibers, and/or aramid fibers are advantageously embedded within the second plastic.

In another possible embodiment of the cylinder core, a filled conducting plastic can be used as electrically-conducting first plastic, in which a conducting filler, such as carbon black or chimney soot, carbon fibers or metal powder is added to a heat-curing or thermoplastic resin. As an alternative, a self-conducting plastic can be used as first plastic based on polymers that are made electrically conducting by oxidation, reduction, or protonation (doping).

The electrical conductivity of the filled conducting first plastic depends on the mutual contacts between the conducting solid filler particles. It has been found that a well dispersed filler with about 10 to 50 wt % is required in order to produce composite materials with good conductivity. Conducting plastics, on the other hand, can be produced from organic polymers that contain long conjugated chains formed by double bonds and heteroatoms. The polymers can be made conducting, for example, by modification of the $\pi$ and $\pi$-p electron systems in their double bonds and heteroatoms by adding certain mixing or doping agents to the polymer that serve as electron acceptors or electron donors in the polymer. Electron holes or additional electrons are thereby formed in the polymer chain so that electrical current can flow along the conjugated chain. An advantage of self-conducting plastic is the ease with which its conductivity can be varied as a function of the amount of dopant, i.e., the degree of doping, especially within low-conductivity ranges. On the other hand, the limited conductivities with filled conducting plastics can be achieved without major expense.

In addition to an electrolytic, galvanic application of the desired metallic layer, as an alternative, additional coating methods are possible. For example, the metal layer can be applied by evaporation, by a CVD method, by a PVD method, or by dip coating onto the first material element. In this alternative coating method, it is advantageous that the first plastic and the second plastic have corresponding properties, so that simple and reliable coating especially of the head area occurs. It is not absolutely necessary here that the first plastic of the head area be electrically conducting.

In a preferred embodiment of the invention, it has proven advantageous that the control device has a control cam that is connected, in particular, to a base element as a material unit. The control cam can be arranged, for example, on the free side of a cylinder core opposite the head area. When a cylinder core is rotated about its axis, the control device is moved simultaneously, which again moves the locking device arranged in the closure device for a closing and/or opening process. The control device can also be designed as a type of groove. In addition, different positions of the control device on the holding area are conceivable, on which the control device can be arranged. Depending on the corresponding design of the closure device, the control device can also be positioned on the outer area of the holding area between the free end of the holding area and the head area. Several control devices are also conceivable as an alternative.

Another improving step proposes that the cylinder core can be arranged in a housing of a closure cylinder, which is one possible embodiment of the closure device in which the cylinder core has at least one blocking device that prevents a movement in its blocking position, especially rotation of the cylinder core with respect to the housing of the closure cylinder and permits, in its release position, a movement, especially rotation of a cylinder with respect to the housing of the closing cylinder with the key, whereby the blocking device is assigned to a blocking groove formed on the holding area. The holding area is preferably designed with several spaced blocking grooves designed as openings. Blocking devices (tumblers) can be guided by the blocking grooves so that a blocked position of the cylinder core is produced, i.e., the cylinder core is locked to the cylinder housing by means of the tumblers.

The holding area is advantageously designed with a stop element that faces the head area. When a cylinder core rotates from its blocking position to its release position and vice versa, the stop element encounters a stop surface arranged on the closure cylinder housing, so that further rotation of the cylinder is prevented.

It can also be provided according to the invention that the head area is designed with double walls, having an outer and inner wall. At least one open cavity can be formed between the outer and inner wall into which the holding area extends. Preferably, several cavities are formed, forming a type of chamber system. The cavities are preferably designed to be open in the direction of a holding area, so that the holding area can reliably fill up the cavities. Through this design embodiment of a cylinder core, a reliable connection between the head area and the holding area is achieved. In this embodiment of the invention, exclusively the head area is formed from the first material element. The holding area and the control device represent the second material element. Since the holding area extends into the cavities of the head area, material reinforcement of the head area can be achieved.

The outer and inner walls are preferably connected by at least one connector. The inner wall includes the key channel, whereby the inner wall can be adapted to the shape of the key channel. In one possible alternative of the invention, the inner wall is designed to be continuous in the form of a rectangle. Starting from the inner wall, one or more connectors run to the outer wall. The cavities of the head area are thus formed by the outer and inner wall and the connectors.

It is also conceivable that at least one additional connector extends from the inner wall in the direction of the stop element, whose free end has a spacing to the outer edge area of the stop element.

BRIEF DESCRIPTION OF THE DRAWINGS

Additional advantages, features, and details of the invention can be seen from the dependent claims and the following description, in which several embodiment examples of the invention are described in detail with reference to the drawings. The features mentioned in the claims and description can then be essential to the invention individually or in any combination. In the drawings:

DETAILED DESCRIPTION OF THE INVENTION

Figure 1:
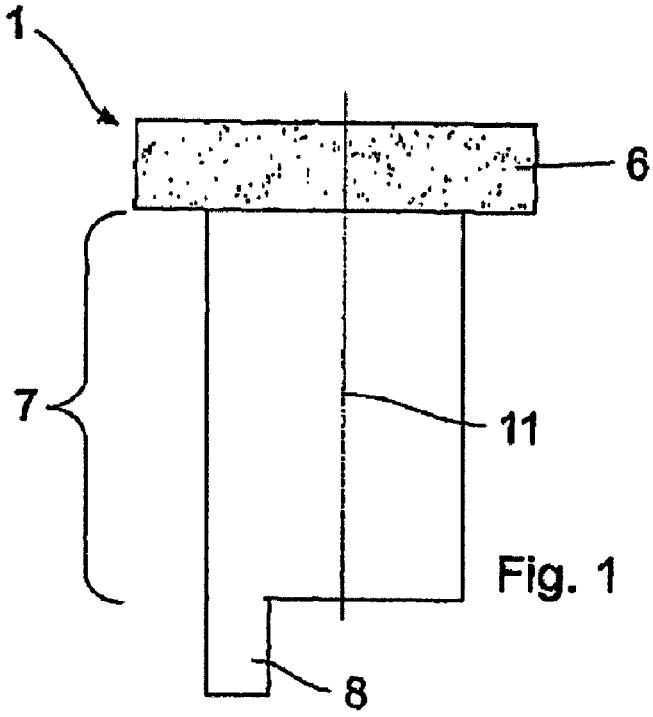
FIG. 1 shows a purely schematic view of a cylinder core having a first and second material.

In FIG. 1, a cylinder core 1 is shown that can be arranged to rotate in a closure device of a vehicle. The closure device mentioned can be located, for example, in a console storage compartment or glove compartment of the vehicle. The cylinder core 1 has a head area 6 as well as a holding area 7 arranged beneath head area 6, which has a control device 8 on its free end. The head area 6 here comprises of a first material element 6 and a holding area 7, while the control device 8 comprises of a second material element. According to the invention, the first material element 6 contains a first plastic and the second material element 7, 8 and a second plastic, whereby according to FIG. 1, as also in FIGS. 2 to 6, the second plastic has a higher strength than the first plastic.

Figure 2:
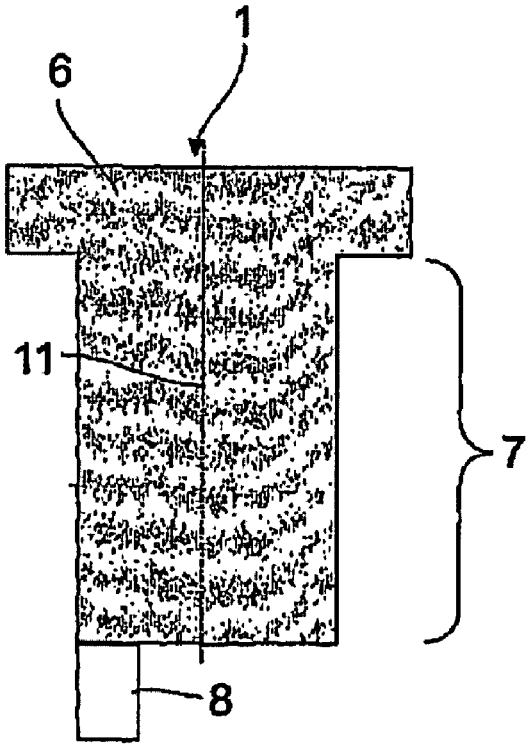
FIG. 2 shows another alternative of the cylinder core according to FIG. 1.

In another embodiment of the invention, FIG. 2 shows a cylinder core 1 comprising a first material element 6, 7 and a second material element 8. The first material element 6, 7 is designed with the head area 6 and the holding area 7 which are connected to each other in one material unit. The control device 8 represents a second material element 6.

Figure 3:
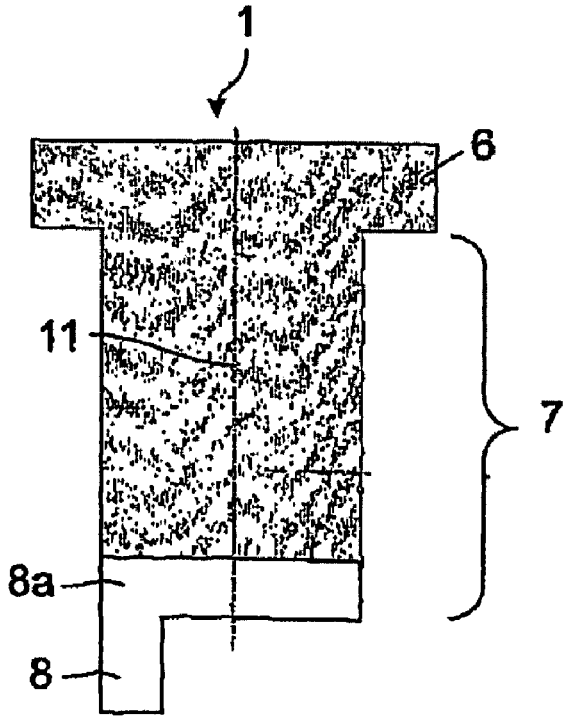
FIG. 3 shows an additional possible embodiment of the cylinder core according to FIG. 1.

In FIG. 3, as also in FIG. 2, the head area 6 and the holding area 7 are formed of the first material element 6, 7. The control device 8 is connected as a material unit to a base element 8*a* and represents a second material element. Here, the base element 8*a* includes the free end of the holding area 7.

The first plastic of the first material element according to FIG. 1 to FIG. 3 is an ABS plastic, initially provided with color pigments, the second plastic of the second material element containing a PC plastic that has a higher strength than the first plastic. The cylinder cores 1 are produced here by a 2C injection molding method.

Figure 4:
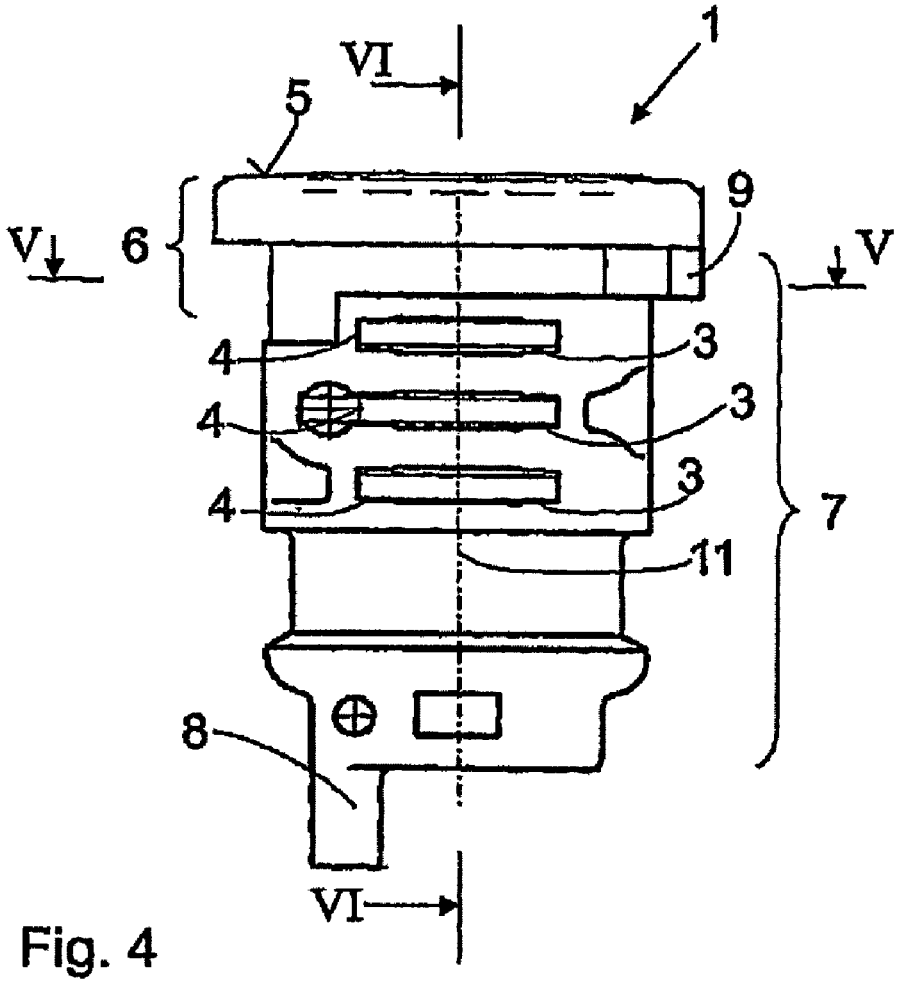
FIG. 4 shows an alternative embodiment of the cylinder core that has blocking grooves and blocking devices.
Figure 5:
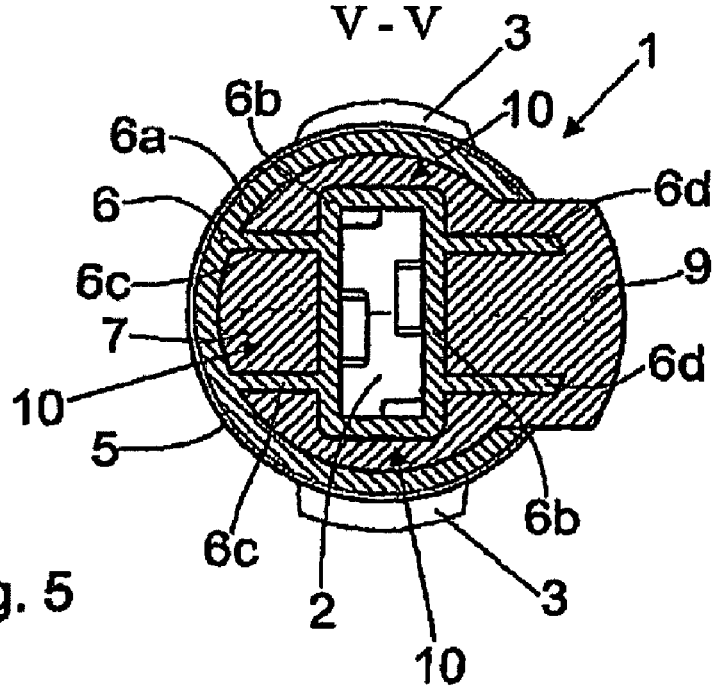
FIG. 5 shows a sectional view along line V-V according to FIG. 4.
Figure 6:
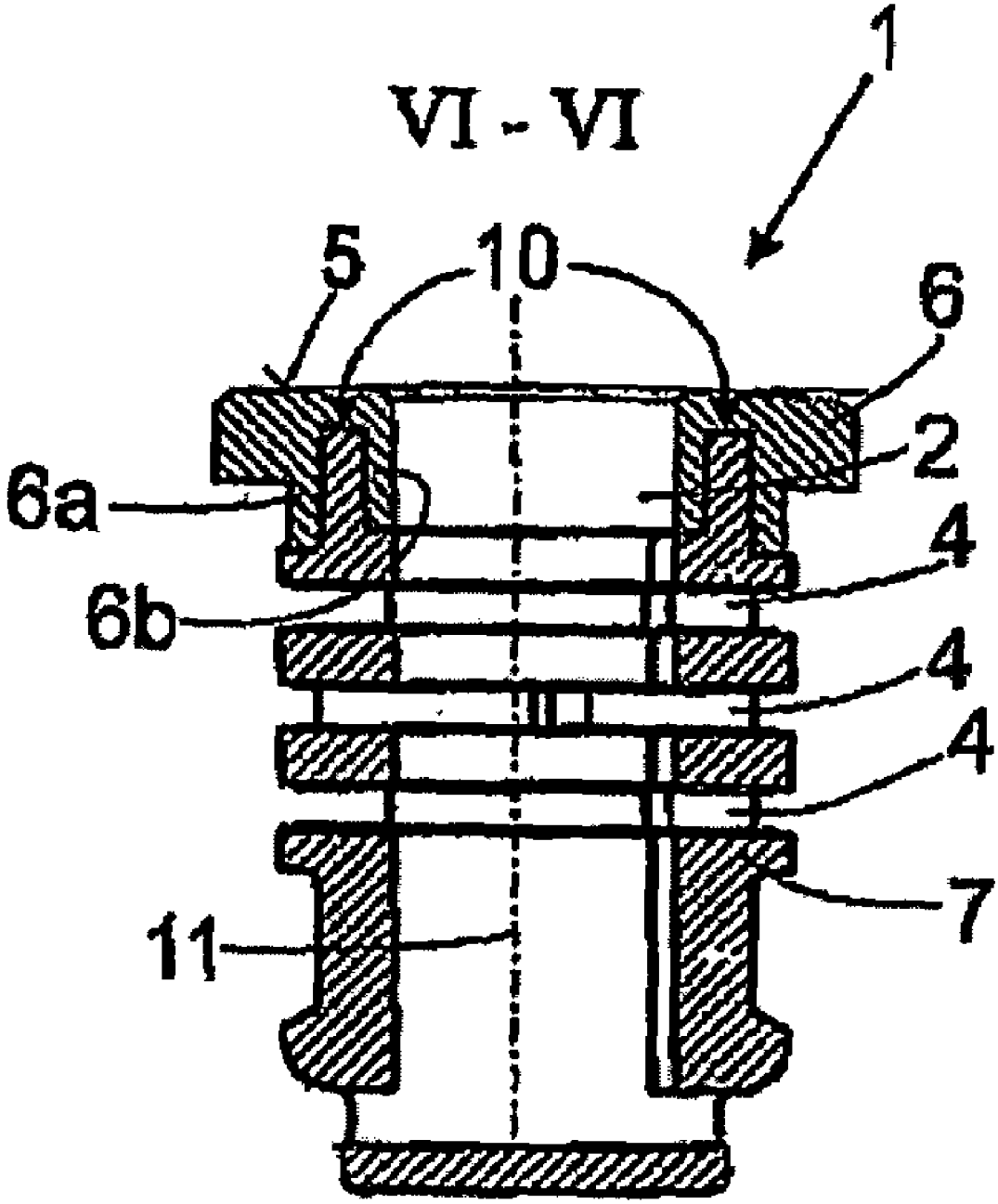
FIG. 6 shows a sectional view along line VI-VI according to FIG. 4.

According to FIGS. 4 to 6, another possible embodiment of the cylinder core 1 is shown, which can be arranged in housing of a closure cylinder (not shown). The cylinder core 1 shown in the present embodiment example is provided for a glove compartment of a vehicle. As shown in the drawings, the cylinder core 1 can be rotated about an axis of rotation 11 within the closure cylinder, so that the cylinder core 1 can be brought from a blocked position to a release position and vice-versa. For this purpose, a key is introduced to a key channel 2, which is shown in FIG. 5 as an example, of the cylinder core 1, in which case blocking devices 3 arranged in cylinder core 1 are brought from their blocked position to a release position. These blocking devices 3 are known as tumblers in the state of the art, which in the embodiment example shown are plates made of metal. A blocking groove 4 is assigned to each blocking device 3, which is formed on the cylinder core 1 as a type of slit-like opening. In the embodiment shown of a cylinder core 1, the blocking devices 3 extend in their blocked position through the corresponding blocking grooves 4 and are in contact with the closure cylinder housing (not shown), so that rotation of cylinder core 1 about its axis 11 is prevented. If the correct key is inserted into the key channel 2, the blocking devices 3 are situated within cylinder core 1 without touching the housing of the closure cylinders, so that the cylinder core can be rotated around its axis 11.

The cylinder core 1 has a first 6 and a second material element 7, 8, whereby the head area 6 is formed by the first material element 6 and holding area 7 and the control device 8 are formed together by the second material elements 7, 8. As in the embodiment examples according to FIGS. 1 to 3, the first material element 6 contains a first plastic and the second material element 7, 8 a second plastic which has a higher strength than the first plastic. The head area 6 comprises of ABS plastic and the holding area 7 arranged beneath the head area 6 is produced from a PC plastic. The head area 6 as well as the holding area 7 are connected to each other in one piece according to the invention, which occurs in the present embodiment example by a 2C injection-molding method. The head area 6 is designed with a metal layer 5 applied by a galvanic method. Galvanizing occurs by electrochemical deposition of a metal onto the electrically conducting ABS plastic by means of an electrolyte. The present material layer 5 is a layer of chromium. The applied chromium layer 5 has a fairly limited thickness, below 20 μm. Naturally, other metals can be used as layer 5, for example, silver, gold, or titanium.

The holding area 7 has the control device 8 on its free end facing the head area 6, which has a spacing from the axis of rotation 11 and is designed as a control cam. In addition, the holding area 7 is designed with a stop element 9, which is flush with the head area 6.

According to FIG. 5, the head area 6 is designed with double walls, having an outer 6*a* and an inner wall 6*b*. The outer wall 6*a* is directly connected to the inner wall 6*b* by connectors 6*c*. The inner wall 6*b* in the present embodiment example has a continuous rectangular shape. On the side of the inner wall 6*b* opposite connectors 6*c*, additional connectors 6*d* extend in the direction of the stop element 9. Blocking devices 3 are also shown, which are located in the block position. Between the outer 6*a* and the inner walls 6*b*, cavities 10 into which the holding area 7 extends are located. As can be seen from FIG. 6, the cavities 10 are designed groove-like, which are completely filled up by the holding area 7 so that the strength of the head area 6 can be reinforced.

The invention claimed is:

1. A cylinder core that can be arranged to rotate in a closure device, especially a center console compartment or a glove compartment of a vehicle, comprising:

a head area, which has a key channel, into which a key can be introduced, and a holding area connected to the head area, which has a control device, which moves a locking device arranged in the closure device when the cylinder core is rotated about its axis of rotation for a closing and/or opening process, wherein the cylinder core has at least two material elements, whereby a first material element comprises the head area that contains a first plastic, and a second material element comprises the control device that contains a second plastic, the second plastic having a higher strength than the first plastic.

2. A cylinder core according to claim 1, wherein the first material element is designed with the head area and the holding area, which are connected to each in one material unit.

3. A cylinder core according to claim 1, wherein the second material element is designed with the holding area and the control device connected to each other in one material unit.

4. A cylinder core according to claim 1, wherein a shape-mating connection exists between the first and the second material elements.

5. A cylinder core according to claim 1, wherein the control device has a control cam that is connected in particular to a base element in a material unit, which encloses a free end of the holding element.

6. A cylinder core according to claim 1, wherein the first material element is designed so that it can be colored and/or galvanized, and/or a color layer can be applied to the first material element.

7. A cylinder core according to claim 1, wherein the first plastic is a material of ABS and/or the second plastic a material of PC, and/or the second plastic has glass fibers, carbon fibers and/or aramid fibers.

8. A cylinder core according to claim 1, wherein the first material element has a metal layer.

9. A cylinder core according to claim 8, wherein that the metal layer can be applied electrolytically, by evaporation, by a CVD process, by a PVD process, or by dip coating.

10. A cylinder core according to claim 1, wherein the cylinder core is produced by a 2C injection-molding method.

11. A cylinder core according to claim 1, wherein the first plastic is conducting.

12. A cylinder core according to claim 1, wherein the cylinder core can be arranged in a housing of a closure cylinder, whereby the cylinder core has at least one blocking device, which in a blocking position prevents a movement comprising rotation of the cylinder core with respect to the housing of the closure cylinder, and in a release position permits a movement comprising rotation of the cylinder core with respect to the housing of the closure cylinder with the key, whereby the blocking device is assigned to a blocking groove made on the holding area.

13. A cylinder core according to claim 1, wherein the holding area is designed with a stop element that faces the head area.

14. A cylinder core according to claim 1, wherein the head area is designed with double walls, having an outer and an inner wall.

15. A cylinder core according to claim 14, wherein at least one open cavity, filled by the holding area, is formed between the outer and inner wall.

16. A cylinder core according to claim 14, wherein the outer wall is connected to the inner wall by at least one connector.

17. A cylinder core according to claim 14, wherein, starting from the inner wall in a direction of stop element, at least one additional connector extends having a free end including a spacing from the outer edge area of the stop element.

* * * * *